US007828585B2

(12) United States Patent
Kurimoto

(10) Patent No.: US 7,828,585 B2
(45) Date of Patent: Nov. 9, 2010

(54) CONNECTOR, PLUG CONNECTOR AND PORTABLE TERMINAL EQUIPMENT

(75) Inventor: Hiromitsu Kurimoto, Kanagawa (JP)

(73) Assignee: Kyocera Elco Corporation (JP)

( * ) Notice: Subject to any disclaimer, the term of this patent is extended or adjusted under 35 U.S.C. 154(b) by 122 days.

(21) Appl. No.: 12/360,532

(22) Filed: Jan. 27, 2009

(65) Prior Publication Data

US 2009/0191729 A1 Jul. 30, 2009

(30) Foreign Application Priority Data

Jan. 30, 2008 (JP) ..... 2008-018851

(51) Int. Cl.
*H01R 13/64* (2006.01)

(52) U.S. Cl. ..... 439/468; 439/357; 439/397; 439/692; 439/942; 439/682

(58) Field of Classification Search ..... 439/468, 439/357, 342, 397, 682, 692, 376, 942
See application file for complete search history.

(56) References Cited

U.S. PATENT DOCUMENTS 1,014,718 A * 1/1912 Parsons ..... 439/502
1,835,109 A * 12/1931 Ayres ..... 439/352
2,258,269 A * 10/1941 Stoner et al. ..... 439/569
2,728,060 A * 12/1955 Doeg ..... 439/685
3,078,433 A * 2/1963 Sheesley ..... 439/278
3,537,062 A * 10/1970 Niskin ..... 439/205
3,551,879 A * 12/1970 Waller, Sr. ..... 439/369
3,602,659 A * 8/1971 Egee et al. ..... 200/50.1
3,795,883 A * 3/1974 Ackerman et al. ..... 439/106
4,109,992 A * 8/1978 Hughes et al. ..... 439/620.21
4,195,894 A * 4/1980 Kotski ..... 439/101
4,289,366 A * 9/1981 Marks ..... 439/293
4,592,611 A * 6/1986 Nitschke ..... 439/345
4,655,522 A * 4/1987 Beck et al. ..... 439/224
4,660,913 A * 4/1987 Turner ..... 439/287
4,820,179 A * 4/1989 Saijo ..... 439/224
4,836,799 A * 6/1989 Tomer ..... 439/284
5,447,454 A * 9/1995 Inaba et al. ..... 439/709
5,816,839 A * 10/1998 Muta ..... 439/342

(Continued)

FOREIGN PATENT DOCUMENTS

JP 2004-178960 6/2004

(Continued)

*Primary Examiner*—Neil Abrams
(74) *Attorney, Agent, or Firm*—McCormick, Paulding & Huber LLP

(57) ABSTRACT

A connector including a receptacle connector and a plug connector. The receptacle connector includes a receptacle insulator in which an accommodation recess is formed, and receptacle contacts mounted on a circuit board, supported by the receptacle insulator. The plug connector includes a plug insulator which is accommodated in the accommodation recess, plug contacts which are supported by the plug insulator, and cables, one ends of which are connected to the plug contacts. Each receptacle contact includes a bifurcated connecting portion. Each plug contact includes a contacting portion held between a bifurcated connecting portion. Engaging/holding grooves are formed on a portion of the plug insulator which faces a bottom surface of the accommodation recess. Each contacting portion is shaped into a flat plate which projects in an opposite direction to that of the other ends of the cables. The receptacle contacts are orientated in a common direction.

7 Claims, 10 Drawing Sheets

U.S. PATENT DOCUMENTS

| | | | | |
|---|---|---|---|---|
| 6,319,015 | B1 * | 11/2001 | Faunce | 439/37 |
| 6,457,988 | B1 * | 10/2002 | Andersen | 439/373 |
| 6,776,620 | B2 * | 8/2004 | Noda | 439/63 |
| 6,830,478 | B1 * | 12/2004 | Ko | 439/579 |
| 6,908,345 | B2 * | 6/2005 | Shimizu et al. | 439/682 |
| 6,910,904 | B2 * | 6/2005 | Herrick et al. | 439/271 |
| 7,001,213 | B2 * | 2/2006 | Kaneko et al. | 439/579 |
| 7,033,203 | B2 * | 4/2006 | Titchener | 439/369 |
| 7,059,918 | B2 * | 6/2006 | Matsumoto et al. | 439/752 |
| 7,112,102 | B2 * | 9/2006 | Masaki et al. | 439/682 |
| 7,121,884 | B2 * | 10/2006 | Osada | 439/582 |
| 7,172,449 | B2 * | 2/2007 | Shindo et al. | 439/341 |
| 7,261,580 | B1 * | 8/2007 | Secora | 439/341 |
| 7,273,390 | B2 * | 9/2007 | Iida et al. | 439/494 |
| 7,303,444 | B2 * | 12/2007 | Denpouya et al. | 439/660 |
| 7,331,812 | B2 * | 2/2008 | Nishio et al. | 439/342 |
| 7,354,313 | B2 * | 4/2008 | Kumazawa et al. | 439/638 |
| 7,430,801 | B2 * | 10/2008 | Iida et al. | 29/883 |
| 7,597,580 | B1 * | 10/2009 | Advey et al. | 439/383 |
| 7,607,943 | B2 * | 10/2009 | Kenjo | 439/579 |
| 2006/0094306 | A1 | 5/2006 | Masaki et al. | |

FOREIGN PATENT DOCUMENTS

| | | |
|---|---|---|
| JP | 2006-128034 | 5/2006 |
| JP | 2006-172738 | 6/2006 |
| JP | 2008-192422 | 8/2008 |

* cited by examiner

CONNECTOR, PLUG CONNECTOR AND PORTABLE TERMINAL EQUIPMENT

CROSS REFERENCE TO RELATED APPLICATION

The present invention is related to and claims priority of the following co-pending application, namely, Japanese Patent Application No. 2008-18851 filed on Jan. 30, 2008.

BACKGROUND OF THE INVENTION

1. Field of the Invention

The present invention relates to a plug connector with plug contacts which are connected to electric wires, a connector which includes this plug connector and an associated receptacle connector mounted on a board, and portable terminal equipment which includes such a connector.

2. Description of the Prior Art

Some surface-mount components (e.g., speakers, microphones and vibration motors) of cellular phones, PDAs (personal digital assistants) and other portable devices are not compatible with reflow soldering which is performed after being temporarily soldered to a circuit board, and therefore cannot be mounted directly to a circuit board.

Accordingly, it is generally the case that receptacle connectors are mounted on (are soldered to) a circuit board, such surface-mount components are connected to plug connectors via electric wires (cables), and the plug connectors are connected to the receptacles.

This type of connector structure is disclosed in Japanese Unexamined Patent Publication No. 2004-55485 (hereinafter referred to as Patent Document 1).

Specifically, the receptacle connector disclosed in Patent Document 1 includes a receptacle insulator with a recessed portion, and two receptacle contacts 132 which are mounted on a circuit board to be fixed thereto so as to face the inner wall and the side surface of the receptacle insulator, respectively. The plug connector includes a plug insulator and two plug contacts and two electric wires (cables), wherein the plug insulator which has dimensions allowing the plug insulator to be completely accommodated in the recessed portion of the receptacle insulator, the two plug contacts are fixed to the plug insulator, and one end of each of the two electric wires is connected to the two plug contacts, respectively, while the other end of each of the two electric wires is connected to the aforementioned surface-mount component.

Therefore, if the plug insulator is fitted into the recessed portion of the receptacle insulator, the plug insulator is completely accommodated in the recessed portion while each plug contact and the associated receptacle contact come into contact with each other, so that the aforementioned circuit board and the electric wires are electrically connected to each other.

In the connector disclosed in Patent Document 1, it is difficult for the plug connector to be provided with more than two electrodes (i.e., more than two plug contacts) since the two plug contacts are fixed to opposite side portions of the plug insulator, respectively. Additionally, it is also difficult for the receptacle connector to be provided with more than two electrodes (i.e., more than two receptacle contacts) since the two receptacle contacts are separated in the lengthwise direction of the receptacle insulator so as to face each other. Supposing that the receptacle connector is designed so that it contains more than two electrodes (i.e., more than two receptacle contacts), e.g., four electrodes which are arranged at regular intervals in the direction of arrangement of the electric wires, the receptacle insulator increases in size in the direction of alignment of the receptacle contacts, so that the plug insulator also increases in size.

In addition, only one side of each plug contact comes in contact with the associated receptacle contact (namely, each receptacle contact comes in contact with the associated plug contact only from one side of the associated plug contact), and accordingly, it is difficult to maintain a stable contacting state between each plug contact and the associated receptacle contact in the case where an external force, which may be produced when the electric wires bend, vibrate or are stretched by cable laying, is exerted on the plug contacts.

It becomes especially difficult to maintain such a stable contacting state when the two electric wires W bend/flex in the direction of arrangement thereof. Namely, in this particular case, the receptacle insulator which receives a force from the electric wires is biased in the direction of arrangement of the electric wires, and accordingly, the contact pressure between one of the two plug contacts and the associated receptacle contact increases while the other plug contact and the associated receptacle contact decreases. Namely, the contact resistance between each plug contact and the associated receptacle contact easily fluctuates due to an external force exerted on the electric wires, so that it tended to be difficult to stabilize the electrical characteristics of the connector and to reduce the difference in the electrical characteristics between the electric wires.

SUMMARY OF THE INVENTION

The present invention provides a connector and a plug connector which are configured so that the plug connector and the associated receptacle connector can contain a plurality of plug contacts and a corresponding plurality of receptacle contacts with a minimum increase in size of the plug insulator and the receptacle insulator, respectively, and so that each plug contact and the associated receptacle contact can be made in contact with each other with stability. The present invention also provides portable terminal equipment which includes such a connector or such a plug connector.

According to an aspect of the present invention, a connector is provided, including a receptacle connector and a plug connector, wherein the receptacle connector includes a receptacle insulator in which an accommodation recess is formed; and a plurality of receptacle contacts mounted on a circuit board, supported by the receptacle insulator, and aligned in a single direction. The plug connector includes a plug insulator which has dimensions that allow the plug insulator to be completely accommodated in the accommodation recess, a plurality of plug contacts which are supported by the plug insulator and aligned in the single direction, the plug contacts being identical in number to that of the receptacle contacts; and a plurality of cables, one ends of which are connected to the plug contacts, respectively. Each of the receptacle contacts includes a bifurcated connecting portion. Each of the plug contacts includes a contacting portion which is held between an associated the bifurcated connecting portion. A plurality of engaging/holding grooves, in which the cables and the plug contacts are engaged and held so that the cables and the plug contacts lie in a common plane, are formed on a portion of the plug insulator which faces a bottom surface of the accommodation recess of the receptacle insulator. Each of the contacting portions is shaped into a flat plate which projects in an opposite direction to that of the other ends of the cables and extends in a direction orthogonal to the common plane. The receptacle contacts are orientated in a common direction.

In an embodiment, a portable terminal equipment including the above described connector can be achieved.

It is desirable for each of the contacting portions to be offset in a direction of arrangement of the cables relative to the one end of an associated the cable.

It is desirable for the plug contact to include at least one cable connecting portion including a bifurcated portion which extends in a direction orthogonal to the one end of the associated cable and holds the associated cable by the bifurcated portion therebetween to thereby be electrically connected with the cable, and the contacting portion.

It is desirable for the receptacle connector to include a lug, wherein the receptacle connector includes at least one metal member integrally fixed to the receptacle insulator and including a supplemental mounting portion, and the lug and the supplemental mounting portion are mounted to the circuit board.

In an embodiment, a plug connector is provided, which is connectable to a receptacle connector, the receptacle connector including a receptacle insulator on which an accommodation recess is formed, and a plurality of receptacle contacts which are mounted on a circuit board, each of which includes a bifurcated connecting portion, are supported by the receptacle insulator, are aligned in a single direction, and orientated in a common direction. The plug connector includes a plug insulator which has dimensions that allow the plug insulator to be completely accommodated in the accommodation recess, a plurality of plug contacts which are supported by the plug insulator, are aligned in the single direction, and are identical in number to that of the receptacle contacts, and a plurality of cables, one ends of which are connected to the plug contacts, respectively. The plug contacts each includes a contacting portion which is held between an associated the bifurcated connecting portion. A plurality of engaging/holding grooves, in which the cables and the plug contacts are engaged and held so that the cables and the plug contacts lie in a common plane, are formed on a portion of the plug insulator which faces a bottom surface of the accommodation recess of the receptacle insulator. Each of the contacting portions is shaped into a flat plate which projects in an opposite direction to that of the other ends of the cables and extends in a direction orthogonal to the common plane.

In an embodiment, a portable terminal equipment including the above described connector can be achieved.

According to the above configurations, the plug insulator does not become extremely large in the direction of alignment of the plurality of plug contacts even if the plug connector is configured as a multi-contact plug connector with a plurality of plug contacts (e.g., four plug contacts) aligned with an equal pitch in the direction of alignment of the plurality of plug contacts, because the contacting portion of each plug contact is shaped into a plate which extends in a direction orthogonal to the plane in which the plurality of cables and the plurality of plug contacts lie.

In addition, the receptacle insulator does not become extremely large in the direction of alignment of the plurality of receptacle contacts even if the receptacle connector is configured as a multi-contact receptacle connector with a plurality of receptacle contacts (e.g., with four receptacle contacts) aligned with an equal pitch in the direction of alignment of the plurality of receptacle contacts, because the plurality of receptacle contacts are aligned and orientated in the same direction, rather than being orientated in a face-to-face arrangement.

According to the present invention, a state where each receptacle contact and the associated plug contact are electrically connected to each other with a high degree of reliability is achieved because each receptacle contact includes a bifurcated connecting portion which holds the contacting portion of the associated plug contact.

Specifically, an effect of such a highly reliable connection state becomes conspicuous when the cables bend in the direction of arrangement thereof. Namely, the bifurcated connecting portion of each receptacle contact continues to hold the contacting portion of the associated plug contact even though the plug connector slightly rotates inside the accommodation recess of the receptacle insulator when the cables are moved from side to side. In addition, because the plug connector in this case rotates about a rotational center in the vicinity of the contact points between the contacting portions of the plurality of plug contacts and the bifurcated connecting portions of the plurality of receptacle contacts, no great force (moment of rotation) is easily exerted on any of the contact points. Accordingly, even if the cables are moved from side to side in the direction of arrangement thereof, each plug contact and the associated receptacle contact can easily maintain a stable contact state therebetween by such stable holding. Consequently, a connector wherein the electrical characteristics thereof are stabilized while a difference in characteristics between the cables is prevented from occurring even if an external force is exerted on the cables when, e.g., the cables are bent, can be achieved.

According to the present invention, since each of the contacting portions of the plurality of plug contacts are offset relative to the direction of extension of one end (proximal end) of the associated cable, the plug connector (plug insulator) cannot be connected to the receptacle connector (receptacle insulator) unless the upper and lower sides of the plug connector (plug insulator) are properly orientated relative to the receptacle connector (receptacle insulator). Accordingly, there is no chance of the plug connector (plug insulator) being connected to the receptacle connector (receptacle insulator) with the plug connector being orientated upside down.

Furthermore, since the user can visually confirm that the contacting portions of the plurality of plug contacts are offset relative to the cables, the upper and lower faces of the plug insulator can be correctly recognized based on this offset state. Therefore, there is little likelihood that the user will try to connect the plug connector (plug insulator) to the receptacle connector (receptacle insulator) with the upper and lower faces of the plug insulator in a reversed orientation.

According to the present invention, the receptacle connector has an increased anti-detachment prevention relative to the circuit board. Accordingly, even if the cables are moved from side to side, an adverse effect on the contact state between each receptacle contact and the associated plug contact can be minimized.

BRIEF DESCRIPTION OF THE DRAWINGS

The present invention will be discussed below in detail with reference to the accompanying drawings, in which.

DESCRIPTION OF THE PREFERRED EMBODIMENT

Figure 1:
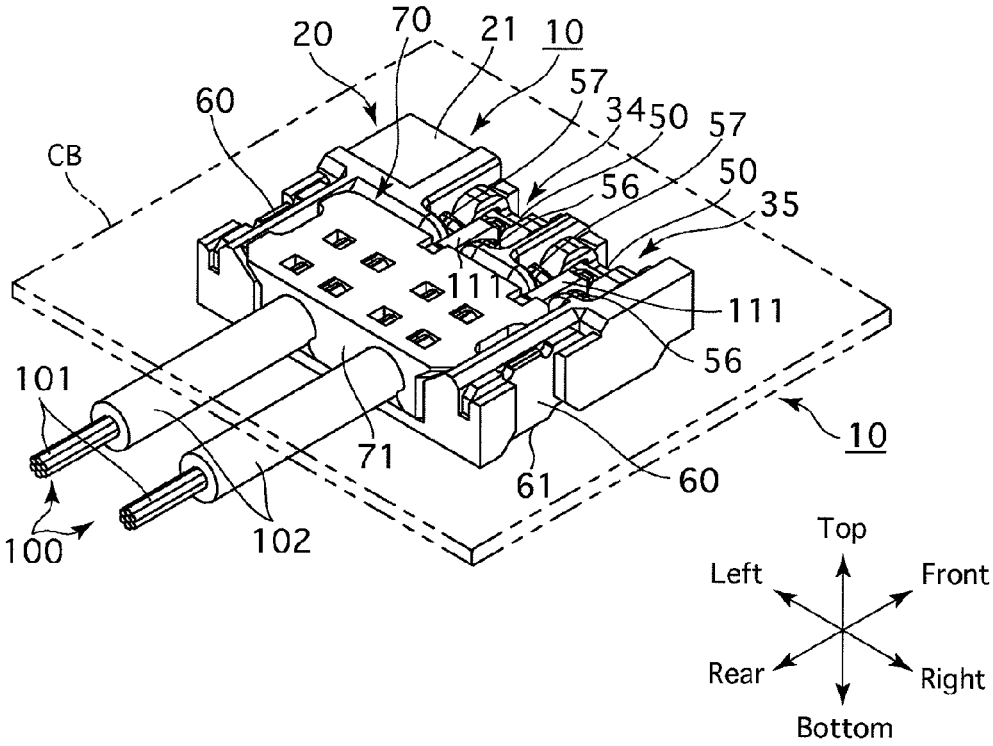
FIG. 1 is a rear perspective view of an embodiment of a connector including of a plug connector and a receptacle connector, according to the present invention in a connected state, in which the plug connector and the receptacle connector are connected to each other, viewed obliquely from the upper rear direction.

An embodiment of a connector according to the present invention will be hereinafter discussed with reference to the accompanying drawings. Note that forward, rearward, leftward and rightward directions of the connector (receptacle/plug) in the following descriptions are determined with reference to the double-headed arrows shown in FIGS. 1, 2, 3, 5, etc.

The connector 10 is provided with a receptacle connector 20 and a plug connector 70 which can be connected and disconnected to and from each other. The connector 10 is a low-profile connector which is approximately 1 mm in height and configured to electrically connect a component (e.g., a speaker, a microphone or a vibration motor) within a cellular phone, a PDA (personal digital assistant) or other portable terminal equipment, to a circuit board CB.

Firstly, the receptacle connector 20 will be hereafter discussed in detail with reference mainly to FIGS. 10 through 13. The receptacle connector 20 is provided with a receptacle insulator 21, two receptacle contacts (electrodes) 50 and two reinforcing metal pieces (metal members) 60 which are major components of the receptacle connector 20.

The receptacle insulator 21 is a substantially rectangular solid-shaped element made of an insulating and heat-resistant synthetic resin (e.g., nylon, liquid-crystal polymer or polyphenylene sulfide) by injection molding.

The receptacle insulator 21 is provided in the rear thereof with an accommodation recess 22 which is recessed downward from the upper surface of the receptacle insulator 21 and the rear end of which is open. The receptacle insulator 21 is provided at the left and right sides thereof with a left side wall 24 and a right side wall 25, respectively, which define the left and right sides of the accommodation recess 22, respectively. The left side wall 24 and the right side wall 25 are each provided on inner surfaces thereof with a lock lug 26, so as to constitute a pair of lock lugs 26 that mutually project inwardly. In addition, each of the left side wall 24 and the right side wall 25 is provided with a metal-piece lock hole 27 in the shape of a letter T in plan view. The left and right metal-piece lock holes 27 extend through the left side wall 24 and the right side wall 25 in the vertical direction, respectively. In addition, each of the left side wall 24 and the right side wall 25 is provided in the front and rear thereof with two lock surfaces 28, respectively. The receptacle insulator 21 is provided immediately in front of the accommodation recess 22 with a front side wall 29, and the front side wall 29 is provided with a pair of slits (left and right slits) 30. The receptacle insulator 21 is provided, on inner surfaces of the left side wall 24 and the right side wall 25 at the rear ends thereof, with two support pillars 31 each having a substantially triangular prism shape. Each support pillar 31 is provided at the upper end thereof with a triangular-shaped beveled support surface 32 formed in a manner to cut off part of the upper end of the support pillar 31.

In addition, the receptacle insulator 21 is provided immediately in front of the front side wall 29 with two contact mounting portions 34 and 35 which are partitioned so as to define left and right spaces, respectively, by a partition wall 33 which extends forward from the front side wall 29. The receptacle insulator 21 is provided immediately below the two contact mounting portions 34 and 35 with two bottom wall portions 36 and 37 (see FIG. 13) which close rear halves of the bottoms of the two contact mounting portions 34 and 35, respectively. The bottom wall portions 36 and 37 are provided, on the upper surfaces thereof at the front ends of the bottom wall portions 36 and 37, with two support walls 38 and 39, respectively, which stand vertically. The two support walls 38 and 39 are provided on rear surfaces thereof with two clearance grooves 40, respectively, which are recessed forwardly and elongated vertically. In addition, the receptacle insulator 21 is provided, immediately in front of the two support walls 38 and 39 on the front end of the receptacle insulator 21, with two engaging recesses 41 and 42.

Each receptacle contact 50 is molded with a stamping die from a thin resilient plate of a copper alloy (e.g., phosphor bronze, beryllium copper or titanium copper) or Corson copper alloy to be shaped into the particular shape shown in the drawings. Each receptacle contact 50 is plated with a nickel coating as a base coating and subsequently plated with a gold coating.

Each receptacle contact 50 is provided in the front thereof with a vertical portion 52 which extends vertically upward, and a bifurcated connecting portion 53 which extends rearward from the upper end of the vertical portion 52. Each receptacle contact 50 is provided in the front thereof with a lug 51 which extends forward from the lower end of the vertical portion 52. The bifurcated connecting portion 53 of each receptacle contact 50 includes a pair of (right and left) holding/connecting pieces 54 and 55. Both the right holding/connecting piece 54 and the left holding/connecting piece 55 extend rearward from the upper end of the vertical portion 52, subsequently extend downward and thereafter extend upward from below. The rear ends of the right holding/connecting piece 54 and the left holding/connecting piece 55 (portions of the right holding/connecting piece 54 and the left holding/connecting piece 55 which extend upward from below) constitute two connecting portions 56 and 57, respectively. The two connecting portions 56 and 57 of each receptacle contact 50 are provided with a pair of holding projections 58, respectively, which project in directions mutually toward each other. Additionally, the vertical portion 52 of each receptacle contact 50 is provided on laterally opposite end surfaces thereof with a pair of engaging lugs 59, respectively.

Although the surface of each receptacle contact 50 is plated with gold as noted above, it is possible that only the surfaces of the lug 51 and the two connecting portions 56 and 57 be plated with gold in each receptacle contact 50 (so that the nickel coating on the receptacle contact is exposed on the surface portion of each receptacle contact 50 between the lug 51 and the two connecting portions 56 and 57). This structure makes it possible to protect each receptacle contact 50 from solder wicking with reliability.

The two receptacle contacts 50 are mounted to the contact mounting portions 34 and 35 so as to be orientated in the same direction and arranged in the left/right direction. Specifically, in each receptacle contact 50, substantially horizontal base end portions of the right holding/connecting piece 54 and the left holding/connecting piece 55 (portions of the right holding/connecting piece 54 and the left holding/connecting piece 55 which are continuous with the upper end of the vertical portion 52) are brought into engagement with the upper surfaces of the two support walls 38 and 39 of the receptacle insulator 21, respectively, the rears of the two holding/connecting pieces 54 and 55 are positioned immediately above the two bottom wall portions 36 and 37, respectively, and the vertical portions 52 of the left and right receptacle contacts 50 are positioned inside the engaging recesses 41 and 42, respectively. Thereupon, as shown in FIGS. 3, and 6 through 9, the lug 51 of each receptacle contact 50 projects downward from a bottom surface of the receptacle insulator 21. In addition, the pair of engaging lugs 59 of each receptacle contact 50 are engaged with the left and right side walls of the associated engaging recess 41 or 42, and accordingly, the left and right receptacle contacts 50 are fixed to the contact mounting portions 34 and 35, respectively.

Each reinforcing metal piece 60 is made from a flat metal plate, and the surface of each reinforcing metal piece 60 is plated with a nickel coating as a base coating and subsequently plated with a gold or solder coating. Each reinforcing metal piece 60 is provided with a soldering portion (supplemental mounting portion) 61 as a lower end portion of the reinforcing metal piece 60, a pair of engaging projections 62 which project forward and rearward from the upper end of the reinforcing metal piece 60, respectively, and a pair of engaging lugs 63 which project forward and rearward from a portion of the reinforcing metal piece 60 in the vicinity of the lower end thereof, respectively.

Upon the left and right reinforcing metal pieces 60 being fitted into the left and right metal-piece lock holes 27 from above, respectively, the pair of engaging projections 62 of the left reinforcing metal piece 60 come into contact with the front and rear lock surfaces 28 of the left side wall 24, respectively, the pair of engaging projections 62 of the right reinforcing metal piece 60 come into contact with the front and rear lock surfaces 28 of the right side wall 24, respectively, and the soldering portion 61 of each reinforcing metal piece 60 projects downward from a bottom surface of the receptacle insulator 21. Additionally, the pair of engaging lugs 63 of the left reinforcing metal piece 60 come into contact (press contact) with the front and rear walls of the left metal-piece lock hole 27 while the pair of engaging lugs 63 of the right reinforcing metal piece 60 come into contact (press contact) with the front and rear walls of the right metal-piece lock hole 27, and accordingly, the left and right reinforcing metal pieces 60 are fixed to the left and right metal-piece lock holes 27 (to be integral therewith), respectively.

Figure 2:
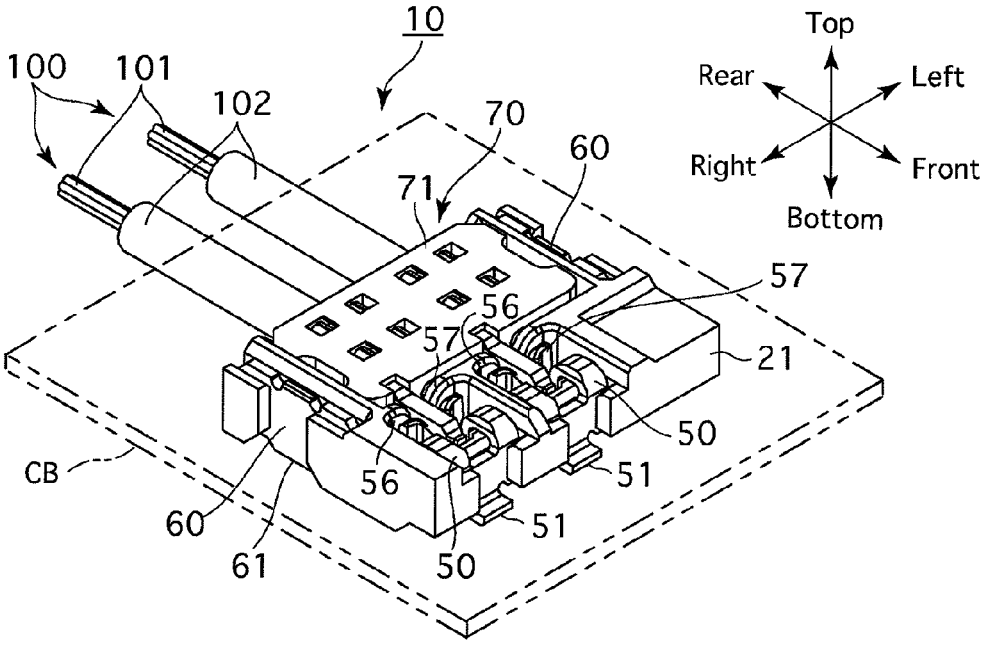
FIG. 2 is a front perspective view of the connector in the connected state, viewed obliquely from the upper front direction.
Figure 3:
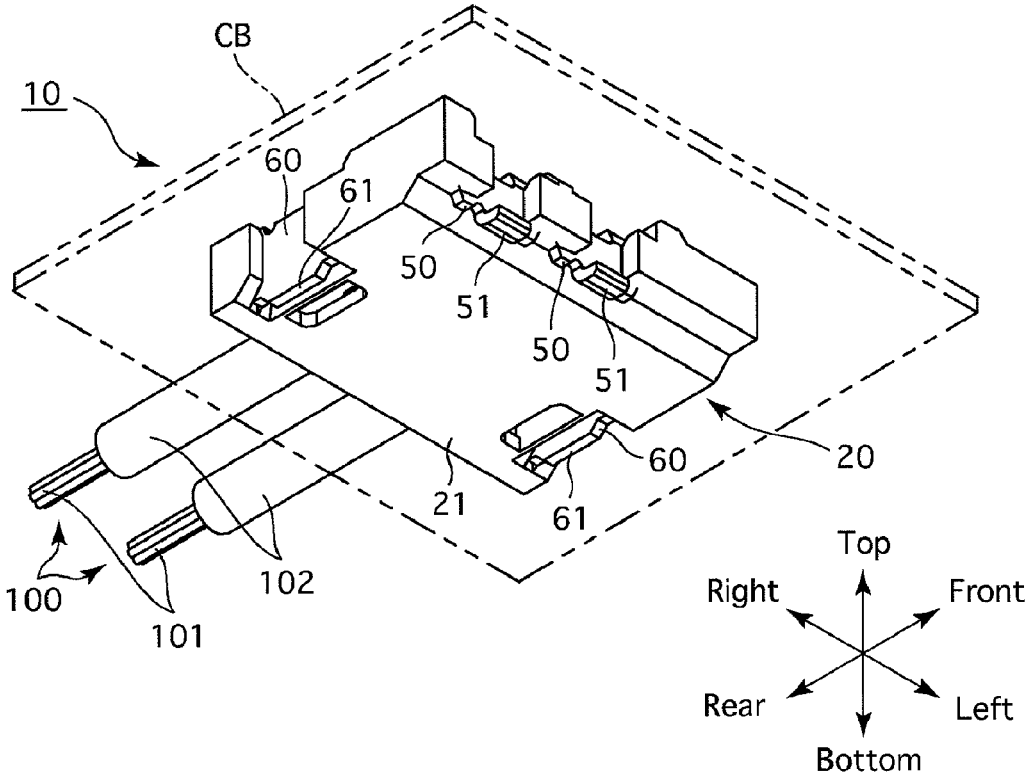
FIG. 3 is a front perspective view of the connector in the connected state, viewed obliquely from the lower front direction.

After the receptacle connector 20 is constructed by combining the receptacle insulator 21, the two receptacle contacts 50 and the two reinforcing metal pieces 60 together in the above described manner, the lug 51 of each receptacle contact 50, which projects downward from a lower surface of the receptacle insulator 21, is soldered to a signal pattern (not shown) formed on the circuit board CB (see FIGS. 1, 2, etc.). Additionally, the soldering portion 61 of each reinforcing metal piece 60, which projects downward from a lower surface of the receptacle insulator 21, is soldered to a pattern for grounding or a pattern not connected to any circuit (not shown) formed on the circuit board CB.

Next, the plug connector 70 will be hereinafter discussed in detail with reference mainly to FIGS. 14 through 19.

The plug connector 70 is provided with a plug insulator 71, two cables 100 and two plug contacts (electrodes) 110, which are major components of the plug connector 70.

The plug insulator 71 is a substantially rectangular solid-shaped element which is molded from an insulated synthetic material (e.g., polycarbonate, nylon, polyphenylene sulfide, etc.) by injection molding. The dimensions of the plug insulator 71 are determined to allow the plug insulator 71 to be completely accommodated in the accommodation recess 22 of the receptacle insulator 21. As shown in the drawings, the plug insulator 71 is provided with a rear wall 72, a front wall 73, a right side wall 74, a left side wall 75, and a center wall 76 which connects the rear wall 72 and the front wall 73 to each other. The rear wall 72 is provided thereon with two (left and right) circular recesses 78 which are substantially circular as viewed from the rear direction.

The inner surface of the plug insulator 71 that is surrounded by the rear wall 72, the front wall 73, the right side wall 74, and the center wall 76 is provided with right central circular-arc (in cross section) surfaces 79 and right front circular-arc (in cross section) surfaces 80 which are aligned coaxially with the right circular recess 78 in the forward/rearward direction, respectively. The right central circular-arc surfaces 79 and the right front circular-arc surfaces 80 are identical in curvature to the right circular recess 78, respectively. In addition, the plug insulator 71 is provided, between the right circular recess 78 and the right central circular-arc surface 79 with a circular-arc connecting surface 81 which connects the right circular recess 78 and the right central circular-arc surface 79 to each other, and is provided between the right central circular-arc surface 79 and the right front circular-arc surface 80 with a circular-arc connecting surface 82 which connects the right central circular-arc surface 79 and the right front circular-arc surface 80 to each other. The right circular-arc connecting surface 81 and the right circular-arc connecting surface 82, which are aligned with each other in the forward/rearward direction, are also circular-arc (in cross section) surfaces which are coaxial with each other and identical in curvature to the right circular recess 78. The right inner surface of the plug insulator 71 is further provided with a rear pair of press-contacting-prong holes 84 and a front pair of press-contacting-prong holes 85 that are positioned in front of the rear pair of press-contacting-prong holes 84, respectively. The right inner surface of the plug insulator 71 is further provided, on the left-hand side of the central circular-arc surface 79, the left press-contacting-prong hole 84 and the left press-contacting-prong hole 85, with a connecting-portion recess 86. The right inner surface of the plug insulator 71 is further provided on the right-hand side of the front circular-arc surface 80 with a middle-portion recess 87, and the front wall 73 of the plug insulator 71 is provided with a front through-hole 88 which is continuous with the middle-portion recess 87. In addition, the plug insulator 71 is provided, immediately above the front through-hole 88 on the front wall 73 thereof, with an engaging recess 89, respectively.

A left circular recess 78, a left central circular-arc surface 79, a left front circular-arc surface 80, a left circular-arc connecting surface 81, a circular-arc connecting surface 82, a left rear pair of press-contacting-prong holes 84, a left front pair of press-contacting-prong holes 85, a left connecting-portion recess 86, a left middle-portion recess 87, a left front through-hole 88 and a left engaging recess 89, which correspond to those of the right half of the plug insulator 71, are formed on a left half of the plug insulator 71.

In addition, the plug insulator 71 is provided at the left and right rear upper corners thereof with two triangular-shaped beveled support surfaces 91 which are identical in inclination angle to the left and right triangular-shaped beveled support surfaces 32 of the receptacle insulator 21, and is further provided on the left and right sides of the plug insulator 71 with two lock recesses 92, respectively.

Each of the two (left and right) cables (electric wires) 100 is provided with a core wire (a strand or a single wire) 101 and a tubular-shaped insulating sheath 102 which covers the surface of the core wire 101. The insulating sheath 102 is a tubular member which is substantially identical in curvature to the circular recesses 78, the central circular-arc surfaces 79, the front circular-arc surfaces 80, the circular-arc connecting surfaces 81 and the circular-arc connecting surfaces 82.

The ends (rear ends) of the two core wires 101 that are not shown in the drawings are connected to an internal component of portable terminal equipment (e.g., a speaker, a microphone or a vibration motor).

Each plug contact 110 is molded with a stamping die from a thin plate of a copper alloy (e.g., phosphor bronze, beryllium copper or titanium copper) or Corson copper alloy to be shaped into the particular shape shown in the drawings. Each plug contact 110 is plated with a nickel coating as a base coating and subsequently plated with a gold coating.

As shown in the drawings, each plug contact 110 is provided with a contacting portion 111, a middle portion 112, a front cable connecting portion (bifurcated portion) 113, a coupling portion 114 and a rear cable connecting portion (bifurcated portion) 115. The contacting portion 111 is in the shape of a flat plate, extends in the forward/rearward direction and lies in a plane orthogonal to a plane (horizontal plane in the drawings) parallel to the plug insulator 71. The middle portion 112 extends rearward from the rear end of the contacting portion 111. The front cable connecting portion 113 extends leftward from the rear end of the middle portion 112. The coupling portion 114 extends rearward from the left end of the front cable connecting portion 113. The rear cable connecting portion 115 extends rightward from the rear end of the coupling portion 114. In addition, the front cable connecting portion 113 and the rear cable connecting portion 115 of each plug contact 110 are provided on top thereof with a front pair of (left and right) press-contacting prongs 117 and a rear pair of (left and right) press-contacting prongs 118 that are positioned behind the front pair of press-contacting prongs 117, respectively. Additionally, each plug contact 110 is provided, on an upper surface of the contacting portion 111 thereof at the rear end of this upper surface, with an engaging projection 120, and is provided on the right side of the rear cable connecting portion 115 with an engaging tab 121.

The left and right cables 100 and the left and right plug contacts 110 become integral with the plug insulator 71 by fixing the left and right cables 100 and the left and right plug contacts 110 to the bottom of the plug insulator 71.

In order to fix each cable 100 and each plug contact 110 to the plug insulator 71, firstly the left and right cables 100 are temporarily held by the bottom of the plug insulator 71 by squeezing the front ends of the left and right cables 100 into the left and right circular recesses 78 while the front ends of the left and right cables 100 are fitted into the left and right circular-arc connecting surfaces 81, the left and right central circular-arc surfaces 79, the left and right circular-arc connecting surfaces 82 and the left and right front circular-arc surface 80, respectively. As shown in the drawings, the dimensions of the lower end openings of the left and right circular recesses 78 are smaller than the diameters of the insulating sheaths 102 of the left and right cables 100, and accordingly, each cable 100 does not accidentally come off the associated circular recess 78 downward after being temporarily held by the plug insulator 71. Thereafter, the pair of press-contacting prongs 117 and the pair of press-contacting prongs 118 of the left plug contact 110 are fitted into the left front pair of press-contacting-prong holes 85 and the left rear pair of press-contacting-prong holes 84, respectively, the pair of press-contacting prongs 117 and the pair of press-contacting prongs 118 of the right plug contact are fitted into the right front pair of press-contacting-prong holes 85 and the right rear pair of press-contacting-prong holes 84, respectively, the coupling portion 114 of each plug contact 110 is brought into engagement with the associated connecting-portion recess 86, the middle portion 112 of each plug contact is brought into engagement with the associated middle-portion recess 87, and the contacting portions of the left and right plug contacts 110 are brought to project forward through the left and right front through-holes 88, respectively. Thereupon, the rear end of the engaging projection 120 of each plug contact engages with the bottom surface (rear surface) of the associated engaging recess 89 while the engaging tab 121 of each plug contact 110 engages with the right wall of the associated right press-contacting-prong hole 84, so that the left and right plug contacts 110 are fixed to the plug insulator 71. Additionally, if the left and right plug contacts 110 are fixed to the bottom of the plug insulator 71 in such a manner, the left and right press-contacting prongs 117 and the left and right press-contacting prongs 118 of each plug contact 110 strip corresponding portions of the insulating sheath 102 of the associated cable 100 and hold the core wire 101 in the associated cable 100 from opposite (left and right) sides. Consequently, the left and right plug contacts 110 are in secure contact with the core wires 101 of the left and right cables 100, respectively, and the left and right cables 100 are completely fixed to the plug insulator 71 via the left and right plug contacts 110, respectively.

Since the left and right cables 100 and the left and right plug contacts 110 are fixed to the plug insulator 71 in such a manner, each cable 100 and each plug contact 110 lie in a horizontal plane (are positioned at the same level), and the lower ends of the left and right cables 100 and the lower ends of the left and right plug contacts 110 are positioned above the bottom surface of the plug insulator 71. In addition, the contacting portions 111 of the left and right plug contacts 110 are offset rightward relative to the left and right cables 100, respectively.

Figure 4:
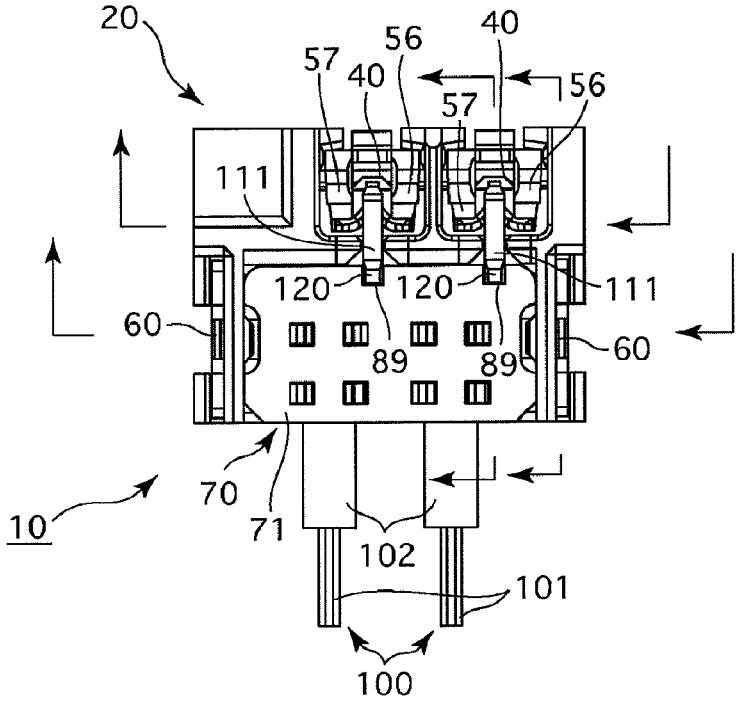
FIG. 4 is a plan view of the connector in the connected state.
Figure 5:
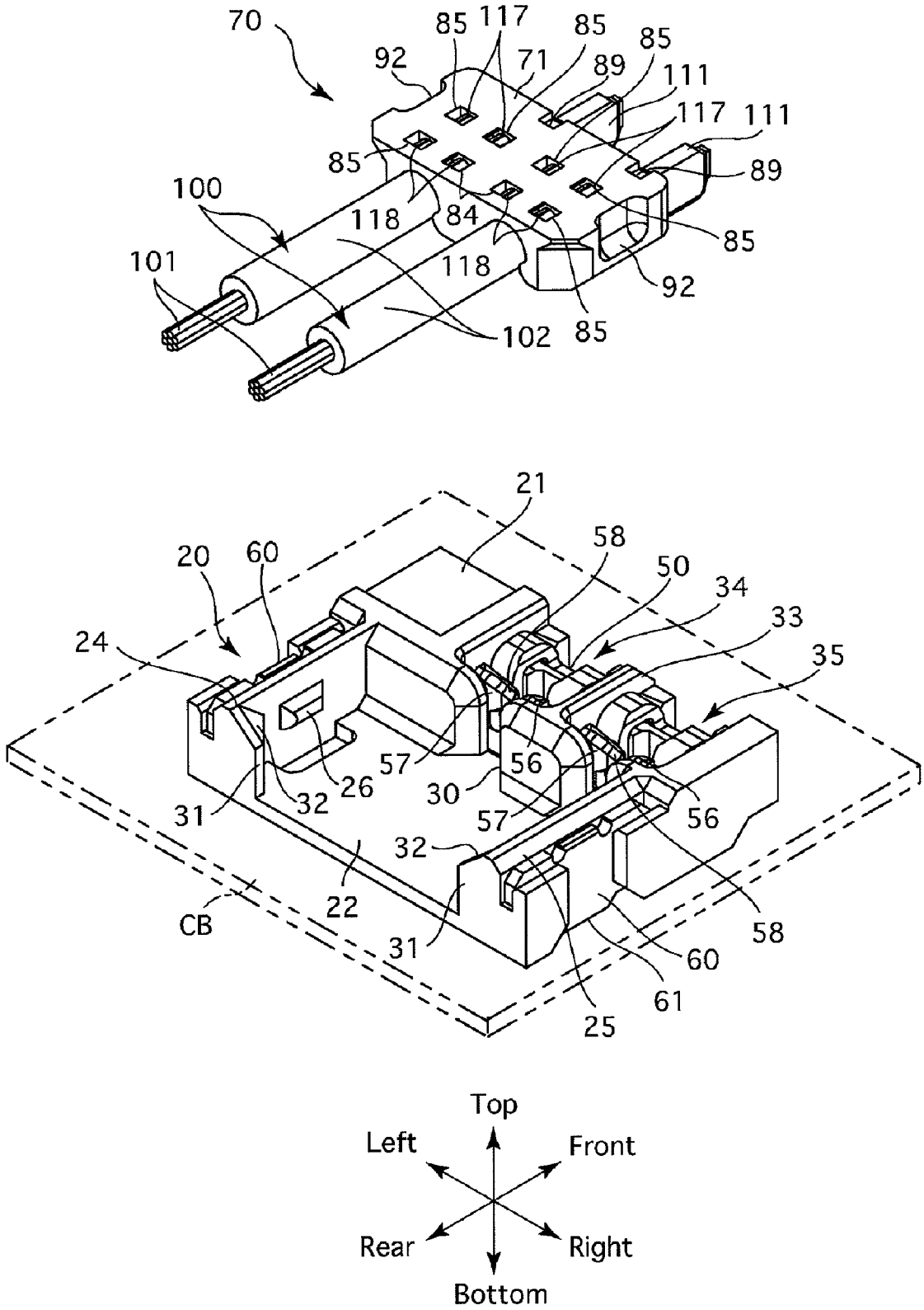
FIG. 5 is an exploded perspective view of the connector, showing a state before the plug connector and the receptacle connector are connected to each other.
Figure 6:
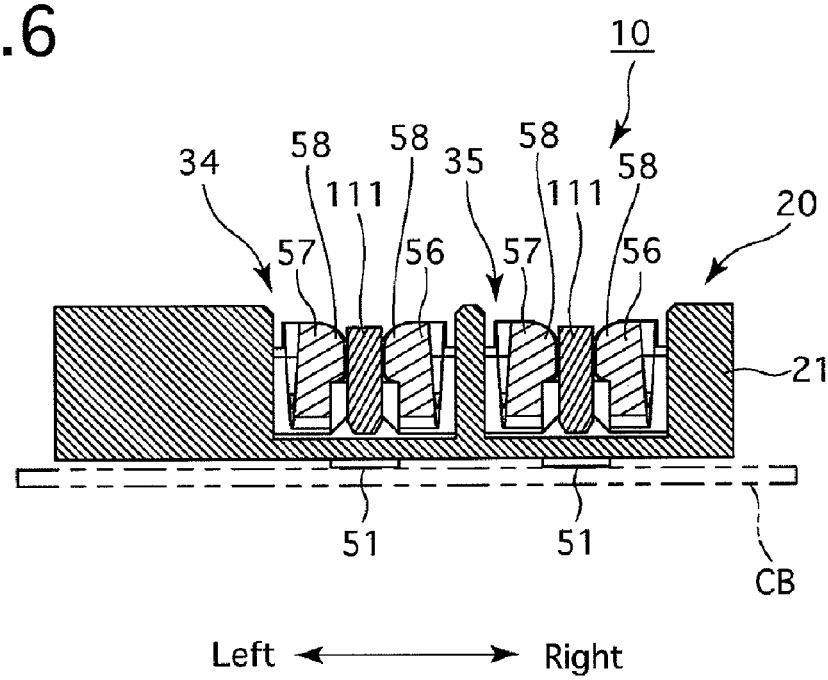
FIG. 6 is a cross sectional view taken along the VI-VI shown in FIG. 4, viewed in the direction of the appended arrows.
Figure 7:
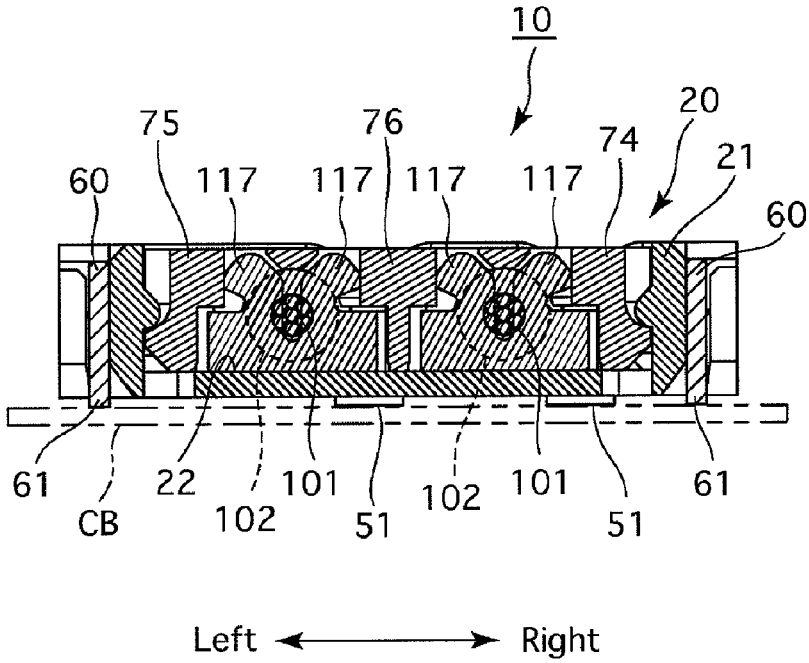
FIG. 7 is a cross sectional view taken along the VII-VII shown in FIG. 4, viewed in the direction of the appended arrows.
Figure 8:
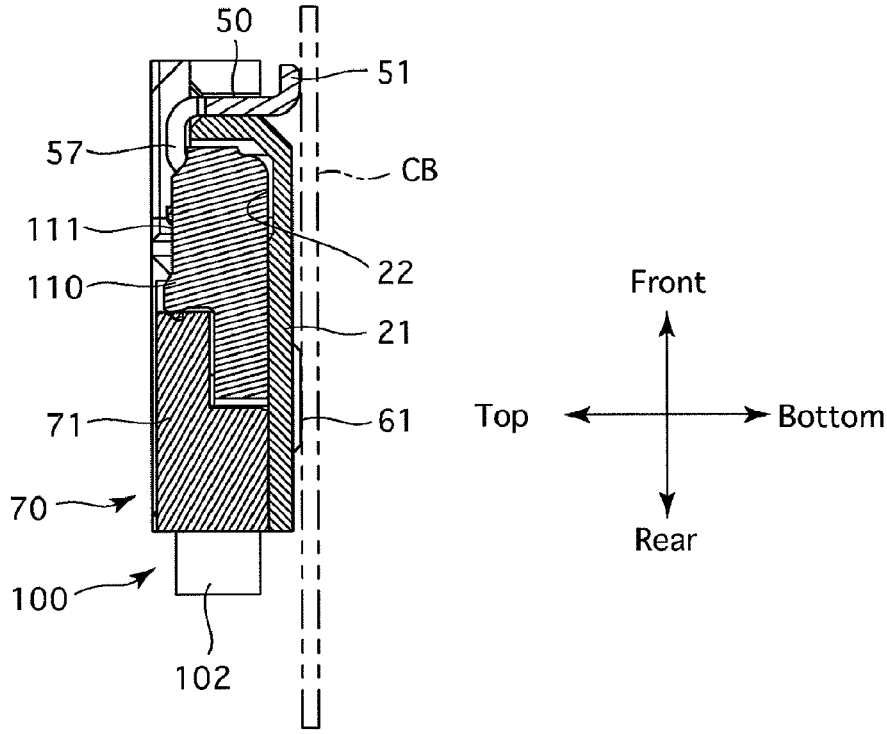
FIG. 8 is a cross sectional view taken along the VIII-VIII shown in FIG. 4, viewed in the direction of the appended arrows.
Figure 9:
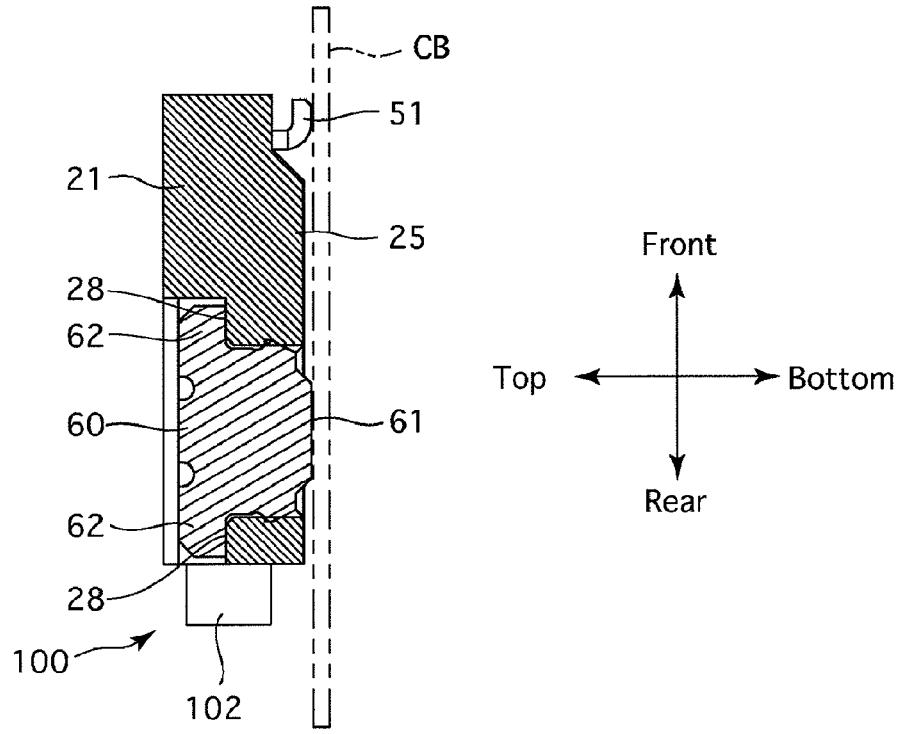
FIG. 9 is a cross sectional view taken along the IX-IX shown in FIG. 4, viewed in the direction of the appended arrows.
Figure 10:
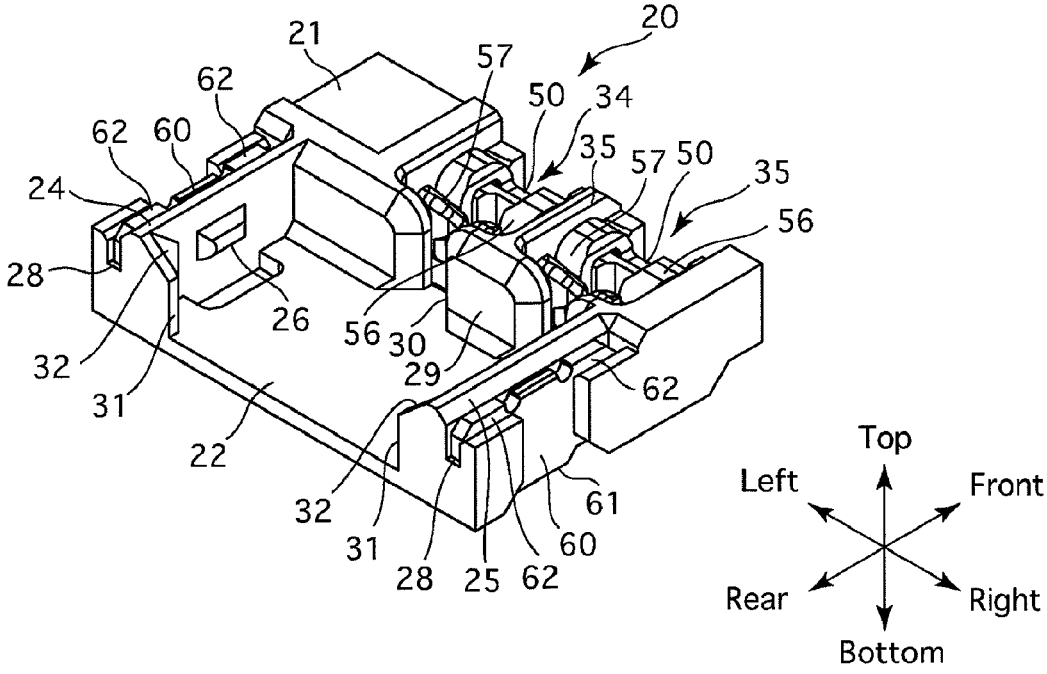
FIG. 10 is a rear perspective view of the receptacle connector, viewed obliquely from the upper rear direction.
Figure 11:
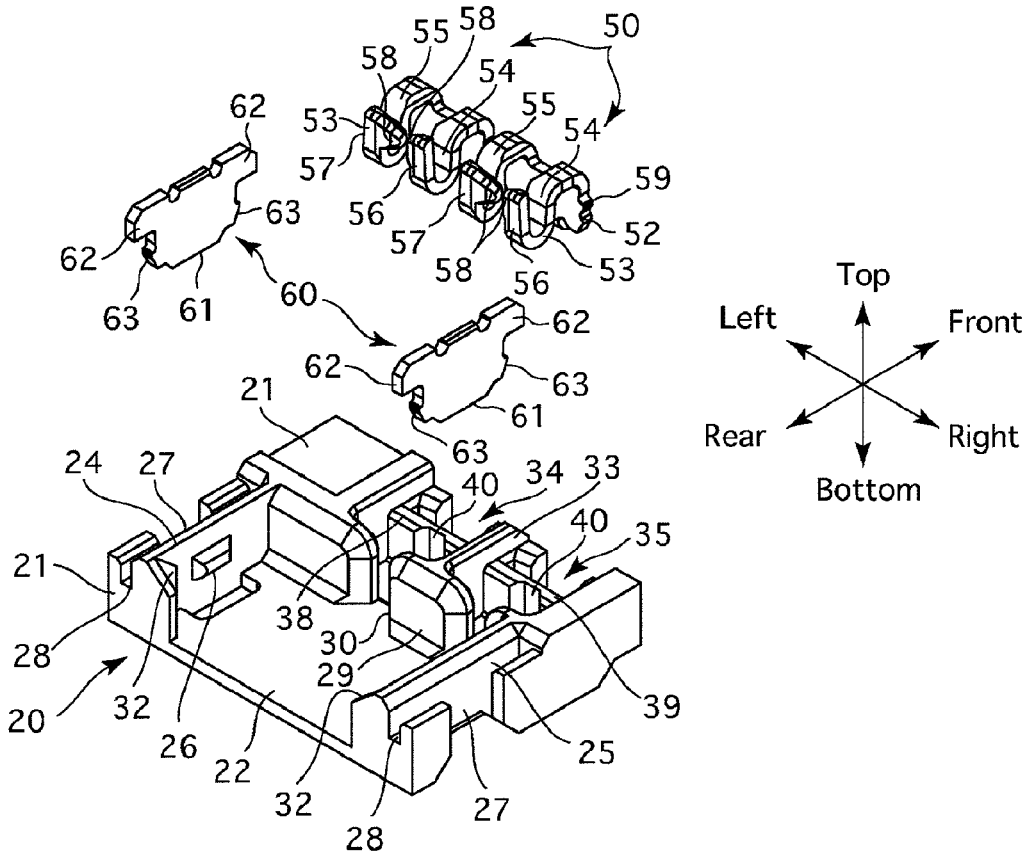
FIG. 11 is an exploded perspective view of the receptacle connector, viewed obliquely from the upper rear direction.
Figure 12:
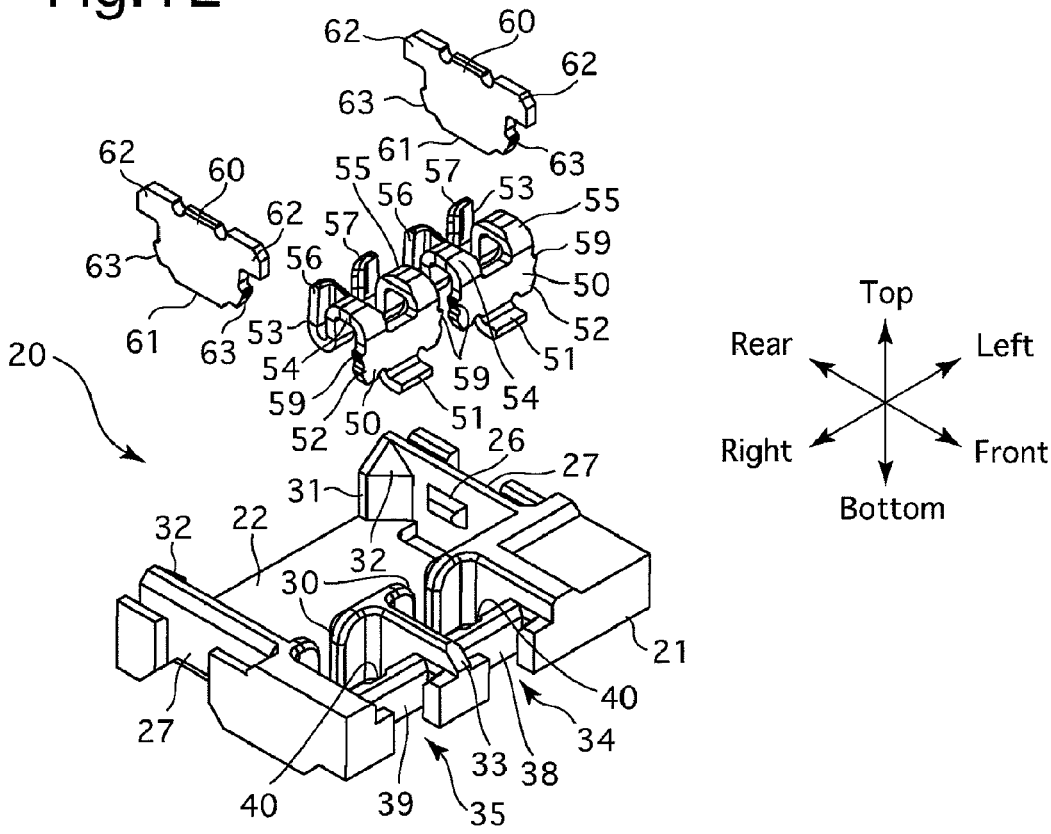
FIG. 12 is an exploded perspective view of the receptacle connector, viewed obliquely from the upper front direction.
Figure 13:
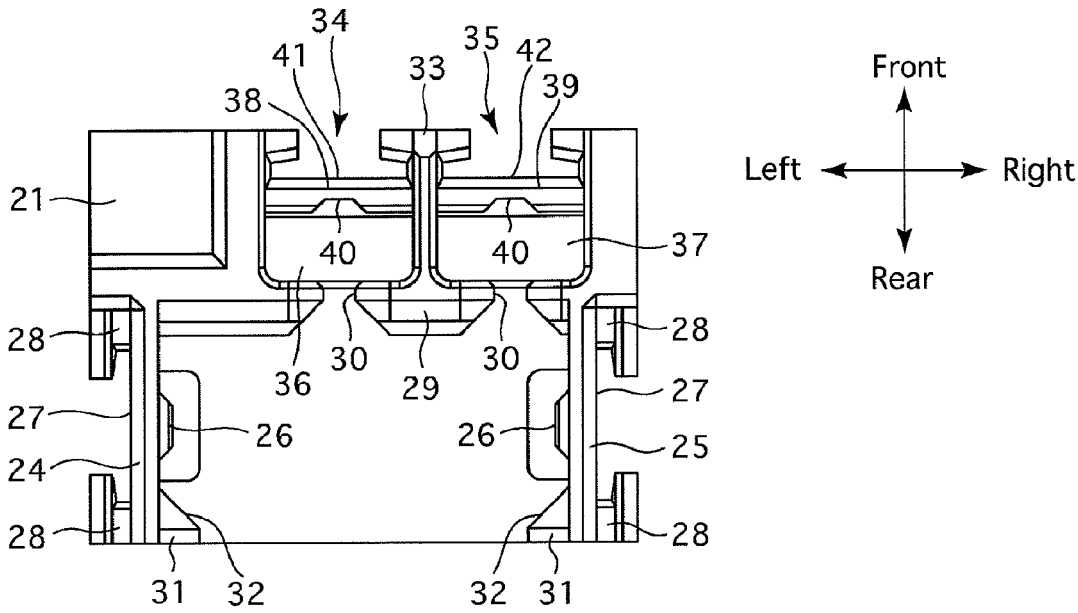
FIG. 13 is a plan view of a receptacle insulator of the receptacle connector.
Figure 14:
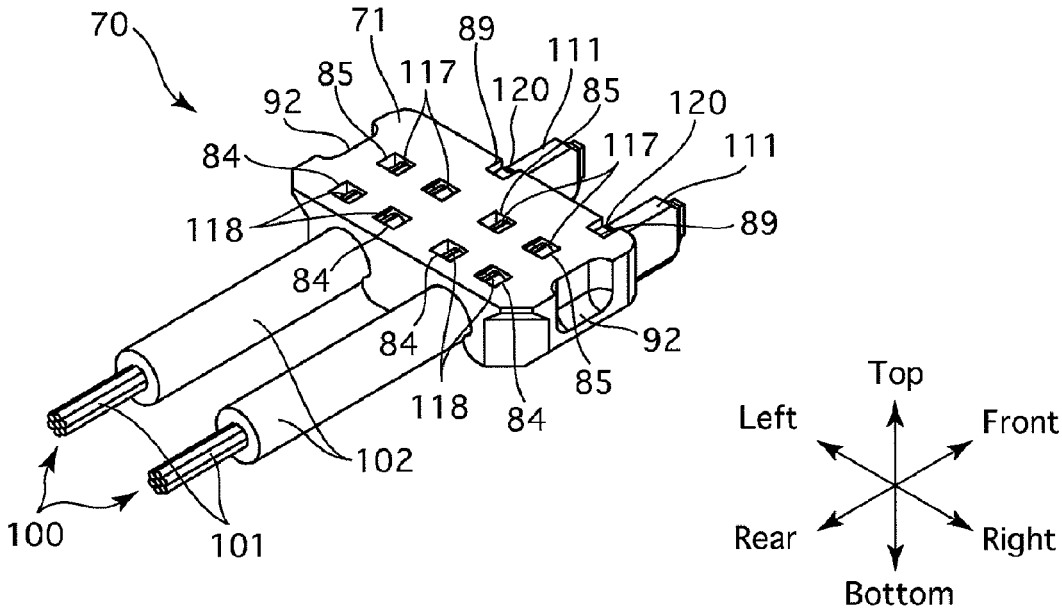
FIG. 14 is a rear perspective view of the plug connector, viewed obliquely from the upper rear direction.
Figure 15:
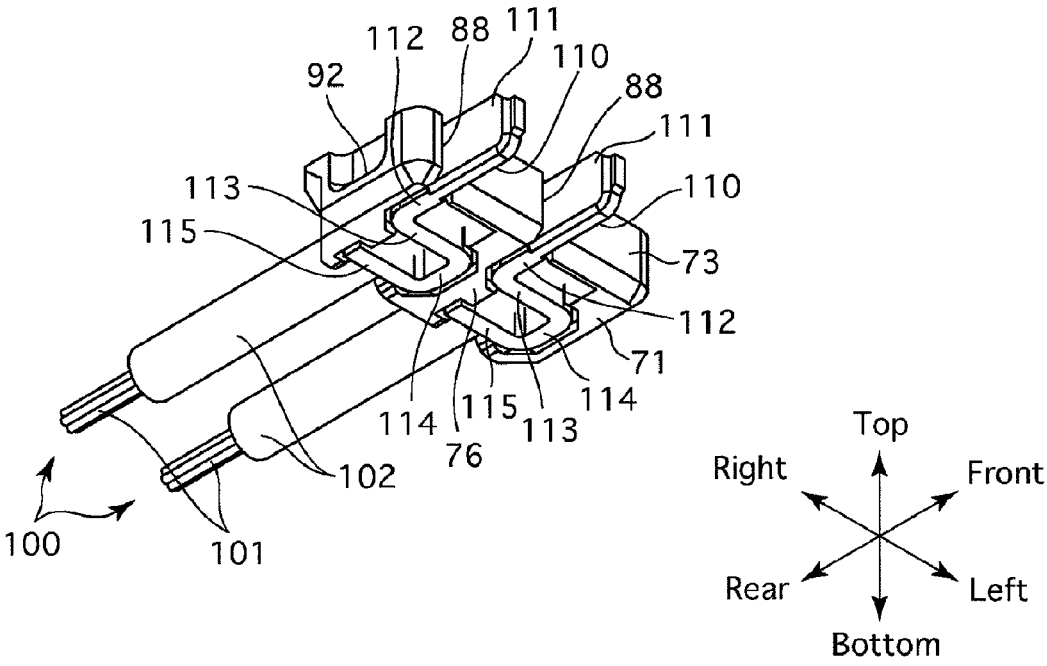
FIG. 15 is a front perspective view of the plug connector, viewed obliquely from the lower front direction.
Figure 16:
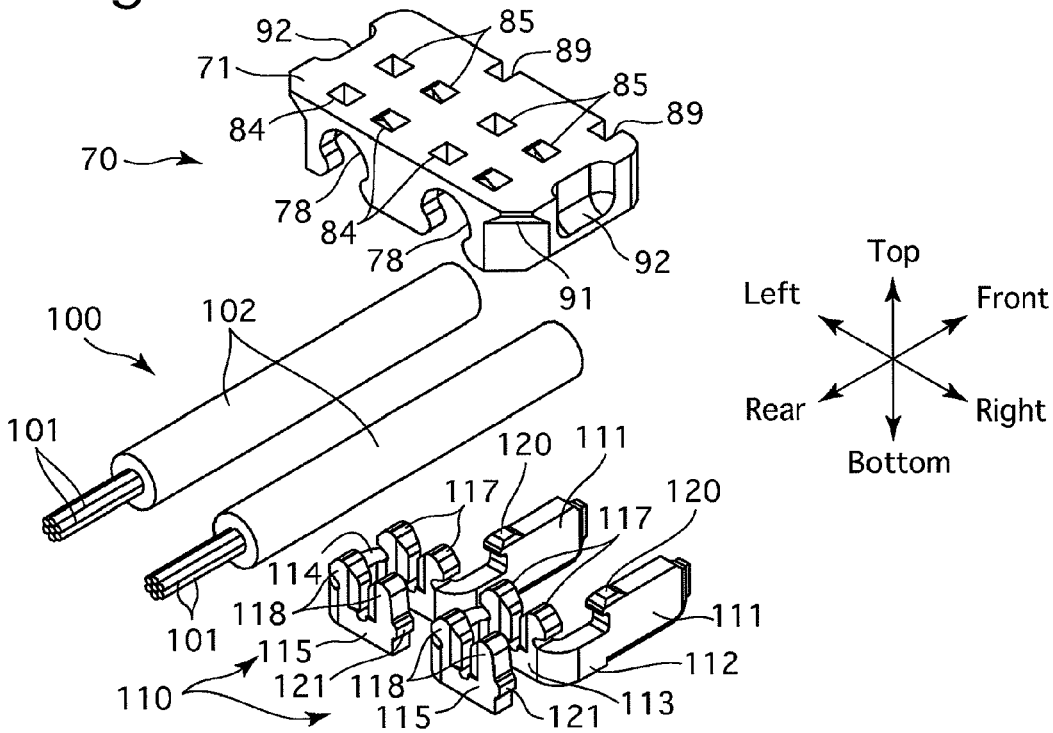
FIG. 16 is an exploded perspective view of the plug connector, viewed obliquely from the upper rear direction.
Figure 17:
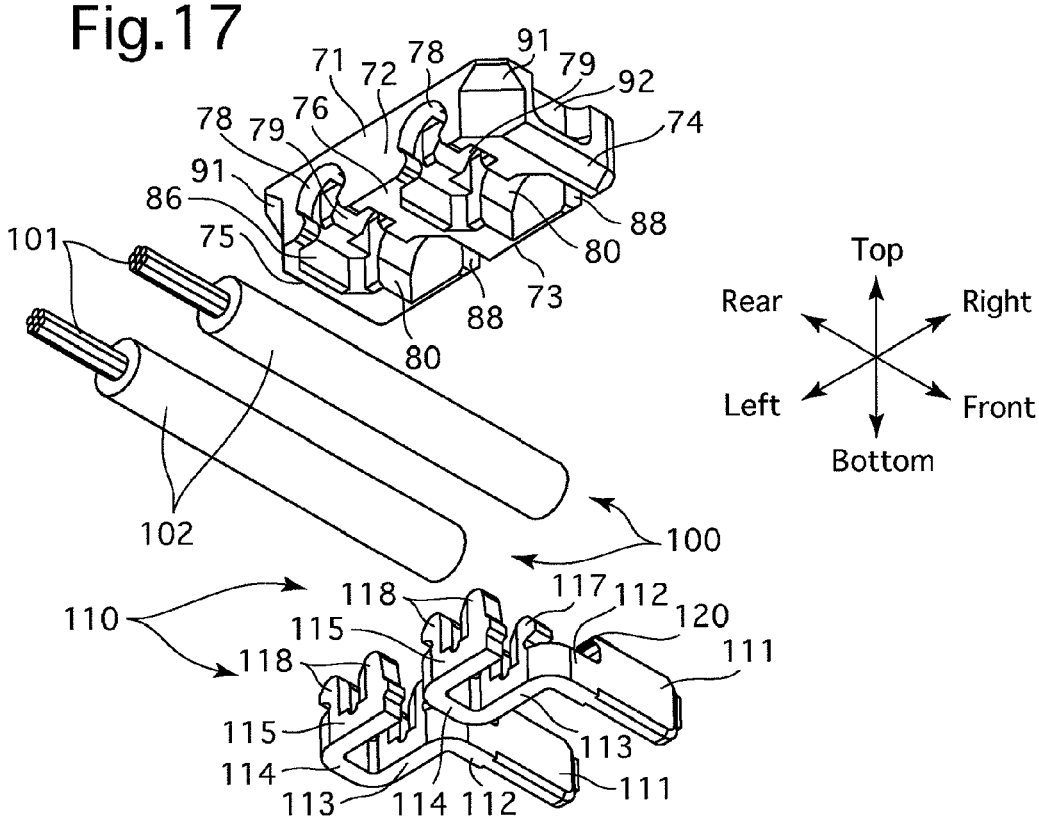
FIG. 17 is an exploded perspective view of the plug connector, viewed obliquely from the lower front direction.
Figure 18:
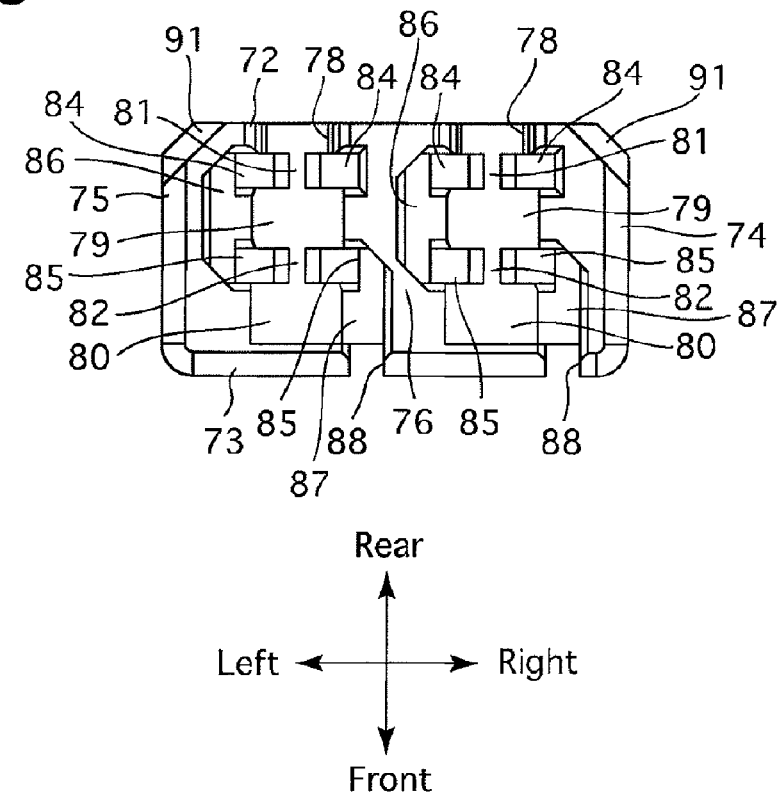
FIG. 18 is a bottom view of a plug insulator of the plug connector.
Figure 19:
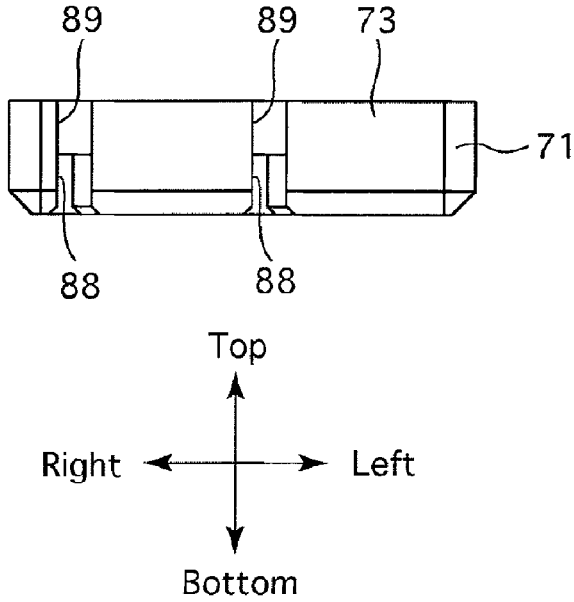
FIG. 19 is a front view of the plug insulator of the plug connector.

In order to connect the receptacle connector 20 and the plug connector 70 to each other, firstly the receptacle connector 20 and the plug connector 70 are orientated relative to each other as shown in FIG. 5. Thereafter, the plug insulator 71 is fitted into the accommodation recess 22 with the orientations of the receptacle connector 20 and the plug connector 70 being maintained, the contacting portion 111 of the left plug contact 110 is fitted into the left slit 30 and the gap between the two connecting portions 56 and 57 (the pair of holding projections 58) of the left receptacle contact 50, the contacting portion 111 of the right plug contact 110 is fitted into the right slit 30 and the gap between the two connecting portions 56 and 57 (the pair of holding projections 58) of the right receptacle contact 50, and the front ends of the left and right plug contacts 110 are positioned inside the left and right clearance grooves 40, respectively (see FIG. 4). Thereupon, the left and right triangular-shaped beveled support surfaces 91 of the plug insulator 71 come into contact with the left and right triangular-shaped beveled support surfaces 32 of the receptacle insulator 21, respectively. In addition, the left and right lock lugs 26 of the receptacle insulator 21 are engaged in the left and right lock recesses 92 of the plug insulator 71, which prevents the plug insulator 71 from accidentally coming off in an upward direction from the accommodation recess 22. Additionally, since the width of the plug insulator 71 is greater than the width of the rear opening of the accommodation recess 22 (i.e., the distance between the laterally-opposed surfaces of the two support pillars 31) in the left/right direction, the plug insulator 71 does not accidentally come off in a rearward direction from the accommodation recess 22.

In addition, the width (in the left/right direction) of each contacting portion 111 of the left and right plug contacts 110 is slightly greater than the gap (left gap) between each set of two connecting portions 56 and 57 (the pair of holding projections 58) of each of the left and right receptacle contacts 50 when the left and right receptacle contacts 50 are in a free state. Accordingly, inserting the contacting portions 111 of the left and right plug contacts 110 into the aforementioned left and right gaps, respectively, causes the two connecting portions 56 and 57 of each receptacle contact 50 to be slightly resiliently deformed in opposite directions to widen the gap therebetween while holding the associated contacting portion 111 with the two connecting portions 56 and 57 remaining slightly resiliently deformed. Therefore, both sides of the contacting portion 111 of each plug contact 110 and the associated receptacle contact 50 are reliably in contact with each other at two points of contact, and accordingly, the aforementioned internal component of portable terminal equipment, to which the rear ends of the core wires 101 of the two cables 100 are connected, and the circuit board CB are electrically connected to each other via the left and right contacting portions 111 and the left and right receptacle contacts 50.

In the above described embodiment of the connector, the plug insulator 71 can be provided so as to have a low profile (small height) since the two cables 100 and the two plug contacts 110 are supported by the plug insulator 71 so as to lie in a horizontal plane (so as to be positioned at the same level). Moreover, the connector 10 can be provided so as to have a low profile (small height) since the plug insulator 71 is completely accommodated in the accommodation recess 22 when the receptacle connector 20 and the plug connector 70 are connected to each other.

Furthermore, the connector 10 can be made into a multi-contact connector, namely, the receptacle connector 20 and the plug connector 70 can be made to contain a plurality of receptacle contacts and a plurality of plug contacts, respectively, with an equal pitch in the left/right (widthwise) direction because the two receptacle contacts 50 are fixed to the receptacle insulator 21 while being orientated in the same direction (not orientated in a face-to-face arrangement) and arranged in the left/right direction, and also because the contacting portion 111 of each plug contact 110 is in the shape of a flat plate orthogonal to a horizontal plane in which the two cables 100 and the two plug contacts 110 lie. Hence, a low-profile and small connector can be achieved even if the number of signal wires (cables/electric wires) is great.

In addition, a state where each receptacle contact 50 and the associated plug contact 110 are electrically connected to each other with a high degree of reliability is achieved because each receptacle contact 50 includes the bifurcated connecting portion 53 that holds the contacting portion 111 of the associated plug contact 110. Specifically, an effect of such a highly reliable connection state is noticeable when the cables 100 bend in the left/right direction.

Namely, the bifurcated connecting portion 53 of each receptacle contact 50 continues to hold the contacting portion 111 of the associated plug contact 110 even if the plug connector 70 slightly rotates inside the accommodation recess 22 of the receptacle insulator 21 if the cables 100 is moved from side to side. In addition, because the plug connector 70 in this case rotates about a rotation center in the vicinity of the two contact points between the contacting portions 111 of the two plug contacts 110 and the bifurcated connecting portions 53 of the two receptacle contacts 50, no great force (moment of rotation) is exerted on either of these two contact points. Accordingly, even if the cables 100 bend in the left/right direction, each plug contact 110 and the associated receptacle contact 50 can easily maintain a stable contact state therebetween. Consequently, even if an external force is exerted on the cables 100 when, e.g., the cables 100 are bent, the electrical characteristics of the connector 10 is stabilized, and a difference in characteristics between the left and right cables 100 is prevented from occurring.

In addition, the plug connector 70 (the plug insulator 71) cannot be connected to the receptacle insulator 21 (the receptacle connector 20) unless the upper and lower sides of the plug connector 70 are properly orientated relative to the receptacle insulator 21 since the contacting portion 111 of each plug contact 110 is offset rightward relative to the front end of the associated cable 100. Additionally, if one attempts to connect the plug connector 70 to the receptacle connector 20 with the plug connector 70 orientated upside down, the left and right triangular-shaped beveled support surfaces 91 come into contact with the upper surface of the receptacle insulator 21, which makes it impossible to connect the plug connector 70 to the receptacle connector 20 since the pair of (left and right) triangular-shaped beveled support surfaces 91 are formed on the plug insulator 71 and also since the pair of (left and right) triangular-shaped beveled support surfaces 32 are formed on the receptacle insulator 21. Hence, the plug connector 70 and the receptacle connector 20 can be prevented from being improperly connected to each other in an effective manner.

Additionally, the operator who connects the plug connector 70 and the receptacle connector 20 to each other can visually recognize that the contacting portions 111 are offset relative to the cables 100, and therefore can properly recognize the upper and lower sides of the plug connector 70 (the plug insulator 71). Accordingly, there is little possibility of the operator attempting to connect the plug connector 70 (the plug insulator 71) and the receptacle connector 20 (the receptacle insulator 21) to each other improperly with the plug connector 70 being orientated upside down.

In addition, the receptacle insulator 21 has an increased anti-detachment prevention relative to the circuit board CB because the two (left and right) reinforcing metal pieces 60 are fitted into the left and right metal-piece lock holes 27 to be fixed to the receptacle insulator 21 and because the soldering portion 61 of each reinforcing metal piece 60 is soldered to the circuit board CB.

Although the present invention has been described based on the above illustrated embodiment of the connector, making various modifications to this embodiment is possible.

For instance, although the above described embodiment of the connector 10 is structured so that each of the receptacle connector 50 and the plug connector includes two electrodes, the connector can be structured so that each of the receptacle connector and the plug connector includes more than two electrodes.

In addition, although each plug contact 110 is provided with two electric-wire contacting portions (the front cable connecting portion 113 and the rear cable connecting portion 115) in the above described embodiment of the connector 10, one of the two electric-wire contacting portions can be omitted.

Additionally, although the two reinforcing metal pieces 60 are used as supplemental mounting portions, it is possible that each receptacle contact 50 be provided, at a position thereon different from the position of the lug 51 of the receptacle contact 50, with a supplemental mounting portion which projects from the receptacle contact 50 to be mounted to the circuit board CB instead of adopting the two reinforcing metal pieces 60.

Obvious changes may be made in the specific embodiment of the present invention described herein, such modifications being within the spirit and scope of the invention claimed. It is indicated that all matter contained herein is illustrative and does not limit the scope of the present invention.

What is claimed is:

1. A connector including a receptacle connector and a plug connector, wherein said receptacle connector comprises:

a receptacle insulator in which an accommodation recess is formed; and a plurality of receptacle contacts mounted on a circuit board, supported by said receptacle insulator, and aligned in a single direction, wherein said plug connector comprises:

a plug insulator which has dimensions that allow said plug insulator to be completely accommodated in said accommodation recess;

a plurality of plug contacts which are supported by said plug insulator and aligned in said single direction, said plug contacts being identical in number to that of said receptacle contacts; and a plurality of cables, one ends of which are connected to said plug contacts, respectively, wherein each of said receptacle contacts includes a bifurcated connecting portion;

wherein each of said plug contacts includes a contacting portion which is held between an associated said bifurcated connecting portion, wherein a plurality of engaging/holding grooves, in which said cables and said plug contacts are engaged and held so that said cables and said plug contacts lie in a common plane, are formed on a portion of said plug insulator which faces a bottom surface of said accommodation recess of said receptacle insulator, wherein each of said contacting portions is shaped into a flat plate which projects in an opposite direction to that of the other ends of said cables and extends in a direction orthogonal to said common plane, and wherein said receptacle contacts are orientated in a common direction.

2. The connector according to claim 1, wherein each of said contacting portions is offset in a direction of arrangement of said cables relative to said one end of an associated said cable.

3. The connector according to claim 2, wherein said plug contact comprises:

at least one cable connecting portion including a bifurcated portion which extends in a direction orthogonal to said one end of said associated cable and holds said associated cable by said bifurcated portion therebetween to thereby be electrically connected with said cable, and said contacting portion.

4. The connector according to claim 1, wherein said receptacle connector comprises a lug, wherein said receptacle connector includes at least one metal member integrally fixed to said receptacle insulator and including a supplemental mounting portion, and wherein said lug and said supplemental mounting portion are mounted to said circuit board.

5. A portable terminal equipment including said connector according to claim 1.

6. A plug connector connectable to a receptacle connector, said receptacle connector including a receptacle insulator on which an accommodation recess is formed, and a plurality of receptacle contacts which are mounted on a circuit board, each of which includes a bifurcated connecting portion, are supported by said receptacle insulator, are aligned in a single direction, and orientated in a common direction, wherein said plug connector comprises:

a plug insulator which has dimensions that allow said plug insulator to be completely accommodated in said accommodation recess;

a plurality of plug contacts which are supported by said plug insulator, are aligned in said single direction, and are identical in number to that of said receptacle contacts; and a plurality of cables, one ends of which are connected to said plug contacts, respectively, wherein said plug contacts each includes a contacting portion which is held between an associated said bifurcated connecting portion, wherein a plurality of engaging/holding grooves, in which said cables and said plug contacts are engaged and held so that said cables and said plug contacts lie in a common plane, are formed on a portion of said plug insulator which faces a bottom surface of said accommodation recess of said receptacle insulator, and wherein each of said contacting portions is shaped into a flat plate which projects in an opposite direction to that of the other ends of said cables and extends in a direction orthogonal to said common plane.

7. Portable terminal equipment including said plug connector according to claim 6.

* * * * *